US005301938A

United States Patent [19]

Casper

[11] Patent Number: 5,301,938

[45] Date of Patent: Apr. 12, 1994

[54] APPARATUS FOR GRIPPING AND REGISTERING SHEETS

[75] Inventor: Cindy L. Casper, Walworth, N.Y.

[73] Assignee: Xerox Corporation, Stamford, Conn.

[21] Appl. No.: 991,923

[22] Filed: Dec. 17, 1992

[51] Int. Cl.[5] ..... B65H 9/04

[52] U.S. Cl. ..... 271/245; 271/243; 271/236

[58] Field of Search ..... 271/243, 244, 245, 236

[56] References Cited

U.S. PATENT DOCUMENTS

| | | | |
|---|---|---|---|
| 2,262,631 | 11/1941 | Belluche | 271/243 |
| 3,924,849 | 12/1975 | Murakami | 271/277 |
| 4,183,519 | 1/1980 | Harris | 271/245 |
| 4,330,117 | 5/1982 | Weisbach | 271/245 X |
| 4,473,222 | 9/1984 | Simmons et al. | 271/245 |
| 4,568,075 | 2/1986 | Bothner | 271/245 X |
| 4,629,315 | 12/1986 | Bruggers | 271/245 X |
| 4,634,112 | 1/1987 | Silverberg | 271/245 |
| 4,721,981 | 1/1988 | Rauen et al. | 271/244 X |
| 4,848,762 | 7/1989 | Beery | 271/19 |
| 4,920,421 | 4/1990 | Stemmle | 358/296 |
| 5,062,602 | 11/1991 | Kress et al. | 271/104 |
| 5,136,336 | 8/1992 | Dastin et al. | 355/274 |
| 5,232,216 | 8/1993 | Bybee | 271/228 |

FOREIGN PATENT DOCUMENTS

| | | | |
|---|---|---|---|
| 0399970A1 | of 0000 | European Pat. Off. . | |
| 280149 | 12/1987 | Japan | 271/245 |

*Primary Examiner*—D. Glenn Dayoan
*Assistant Examiner*—Boris Milef

[57] ABSTRACT

A sheet registering and gripping device for registering and gripping sheets transported along a sheet path. The device includes a registration edge and a gripping edge which extends from the registration edge. The invention further provides an apparatus for actuating the registration edge and gripping edge between a gripping and registering position, and may also include actuation to a third out-of-the-way position to allow substantially free transport of sheets by the registration and the gripping edge.

5 Claims, 5 Drawing Sheets

APPARATUS FOR GRIPPING AND REGISTERING SHEETS

The present invention relates to a relatively low cost method and apparatus for handling sheets at a processing station and, more particularly, to a device for registering and gripping sheets at a processing station.

U.S. patent application Ser. No. 07/992,199, filed concurrently herewith, assigned to the Xerox Corporation, entitled Sheet Handling Device and Method for Transporting Sheets is hereby cross-referenced and incorporated herein by reference thereto.

BACKGROUND OF THE INVENTION

Sheet handlers are well known and, generally, such sheet handlers have a defined path through which sheet material is transported to and from one or more process stations. In image input devices, electrophotographic devices, ink jet printing devices and other such devices, sheet handling devices are employed to sequentially transport sheet material (i.e., sheets of paper and paper-like substrates, such as mylar, vellum, and the like and hereinafter collectively referred to as sheets) to and from image processing stations, such as image input scanning devices, light-lens imaging devices, fusing stations, imprinting stations, transfer stations, and the like.

Sheet handlers of the type in which this invention useful include both sheet handlers which are known as document handlers for sequentially feeding individual documents from a document input station to a document image processing station and then to a document output station, as well as sheet handlers of the type for sequentially feeding individual copy sheets from a copy sheet input station, to a copy sheet imprinting station, and to a copy output station. In general, to restate the foregoing, a sheet handler is employed to transport the sheets to a processing station. Often at such processing stations it is necessary that the transported sheet not only be registered but also held or gripped in place. For example, in some color printers the copy sheet to be printed upon must be delivered to a belt with a registration edge. The sheet then must be gripped on the belt as the sheet is transported through several imaging stations as a composite color image is formed thereon. Likewise, imagining stations adapted for imaging large document also employ apparatus for registering the document to be imaged and gripping the document as it is transported through the imaging station. Other devices also use registering and gripping apparatus to register and hold a sheet in place while an imaging station is moved or otherwise actuated over the sheet to form an image on or from the sheet.

These devices are functional, and they produce reasonably satisfactory results. However, they also tend to be somewhat expensive, not entirely simple and low cost, and not always entirely effective. Thus, there exists a need for a relatively simple, low cost apparatus for registering and gripping sheets transported to a process station.

The following disclosures may be relevant to various aspects of the present invention.

U.S. Pat. No. 3,924,849, Patentee: Murakami, Issued: Dec. 9, 1975

U.S. Pat. No. 4,473,222, Patentee: Simmons et al., Issued: Sep. 25, 1984

U.S. Pat. No. 5,136,336, Patentee: Dastin et al., Issued: Aug. 4, 1992

EP-A-90850156.2, Publication No. 0399970, Filed: Apr. 24,1990, Inventor: Fujino

U.S. Pat. No. 5,062,602, Patentee: Kress et al., Issued: Nov. 5,1991

U.S. Pat. No. 4,920,421, Patentee: Stemmie, Issued: Apr. 24, 1990

U.S. Pat. No. 4,848,762, Patentee: Beery, Issued: Jul. 18, 1989

U.S. Pat. No. 3,924,849 discloses a gripping device for use with a chain driven paper carriage comprising a gripper bar mounted between housing chances having a U-shaped configuration. One leg of the gripper bar is stripped of the upper extremity to form an inner, lower step and a higher outer step. Gripper members are biased into contact with the lower step to grip paper therebetween. An actuated cam is also employed to release the paper from the gripper members after processing and to receive additional paper.

U.S. Pat. No. 4,473,222 discloses an adjustable sheet handling apparatus which includes a member for engaging a sheet along a path. The member is movable into the path to engage a sheet and a second member connected to the engaging member is also movable into the sheet to hold the sheet in the path.

U.S. Pat. No. 5,136,336 discloses a gripper apparatus secured by a movable belt for gripping copy sheets moving in a path and transporting the sheet with the belt through a processing station. The sheet gripper includes an upper and lower gripper portion which is spring biased together. Cam members are provided to periodically open the gripper members to permit release of gripped sheets and to receive another sheet.

European Application No. 90850156.2, Publication No. 0399970 discloses an image scanning apparatus comprising a document feed mechanism which includes a light source and an image sensor reciprocally moved from a home position and a starting position. The document feeding mechanism is mechanically connected to the image sensing unit and moves with the sensing unit. The document feed mechanism includes a functional roller unit which contacts a glass platen, for positioning an image bearing surface face down, and which is coupled to a shaft through a one-way clutch. The clutch inhibits rotation of the roller during movement of the scanning unit and feed mechanism from the home position to the scan starting position and allows rotation during the reverse movement. An operator inserts a document in proper orientation between the frictional roller and the glass patent; the document is then fed or movement to the proper position by the movement of the scanning unit and the feed mechanism from the home position to the scanning position. The document is then scanned during the return movement of the feeder mechanism and s canning unit as the roller freely rotates on the document.

U.S. Pat. No. 5,062,602 discloses the use of a one-way fibrous cloth or pad material, which has fibers oriented toward the rear or upstream position of a feeder tray. The fibers engage the trailing or upstream edge of the sheet above the feed sheet as the feed sheet is fed from a bottom sheet feeder to functionally resist the downstream movement of the sheet above the feed sheet to reduce feeding of multiple sheets from the tray at one time.

U.S. Pat. No. 4,920,421 discloses a combined input and output scanner assembly including a copy sheet transport for transporting copy sheets through the assembly moving a scanning and printing assembly to enable the printing of the copy sheet.

U.S. Pat. No. 4,848,762 discloses a sheet feed apparatus for feeding a sheet from a stack of sheets. A plurality of sheet engaging pressure pads are employed to engage a sheet so that a sheet may be fed from planar and nonplanar stacks.

The foregoing references failed to provide a relatively simple, sheet registering and gripping device for sheets transported to a processing station for processing.

In accordance with one aspect of the present invention, a sheet registration and gripping device for sheets transported by sheet handling apparatus is provided. The invention comprises a sheet registration edge including a first surface for registering the transported sheets, and a second surface substantially perpendicular to the first surface, a gripping surface positioned proximate to the registration edge, and means for moving the registration edge from a first position for registering sheets against the first surface to a second position for engaging sheets by the second surface and gripping sheets between the gripping surface and the second surface. The invention may further comprise a housing adapted to support the registration edge and the gripping surface. The invention in accordance with this aspect may additionally include second means for moving the registration edge to a third position locating the first and the second surfaces remote from the gripping surface to enable sheets to be transported past the first surface and the second surface. Other features of this aspect of the invention may also comprise means for resiliently urging the registration edge selectively to the first position, the second position and the third position, as well as a camming device for moving the registration edge in a direction opposite to the direction of movement urged by the resilient means. The camming device may be a cam which defines a track having said registration edge disposed therein. With the track having raised portions in the track for actuating said first and said second surfaces between the first and the second positions and with the track having laterally displaced portions in the track so as to move the registration edge laterally responsive to movement of the cam.

In accordance with another aspect of the present invention, there is provided a sheet registering and gripping apparatus for registering sheets transported along a path comprising a registration edge, a gripping edge extending from the registration edge, and means for substantially vertically actuating the registration edge so as to move the registration edge between a registering position and a gripping position. The invention in accordance with this aspect may further include means for actuating the registration edge laterally and vertically to move the registration edge and the gripping edge to a remote position enabling the transported sheets to pass the registration edge and the gripping edge.

In accordance with yet another aspect of the present invention a method for registering and gripping sheets transported along a path is provided which comprising the steps of engaging the transported sheets against a registration edge to register individual sheets, lowering the registration edge so that a gripping member extending substantially parallel to the registration edge grips a registered sheet in the path, and translating the registration edge in both a lateral and vertical manner to release a gripped sheet. The method of this aspect of the invention can include a part of the translating step moving the registration edge and the gripping member to a position in a remote location allowing transport of sheets in the path thereby. The method of this aspect of the invention can further include actuating a cam member connected to the registration edge and biasing the registration edge into contact with the cam member.

BRIEF DESCRIPTION OF THE DRAWINGS

Other features of the present invention will become apparent as the following description proceeds and upon reference to the drawings, in which.

Figure 1:
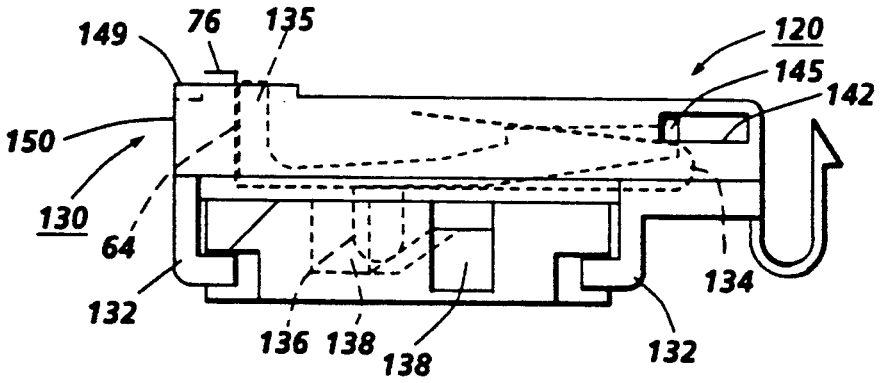
FIG. 1 is an enlarged elevational view of a front edge registering and gripping device according to the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION

The sheet registering and gripping apparatus of the present invention will now be discussed in conjunction with the illustrative image processing device 7 of FIGS. 4A and 4B. An elongated member 10 is supported for movement perpendicular to the longitudinal or central axis of the member 10 over a surface in the direction of arrows 14 and 16, which in this embodiment is generally known as a platen 12. Secured along the base of the member 10 is a brush-like material 18 which has fibers 20 extending therefrom. The material 18 is supported by the member 10 so the fibers 20 and the platen 12 form a sheet engaging area therebetween.

Motive means, in this case a motor 22 and a drive assembly 23, are provided to move a carriage assembly 24, which supports the member 10 in a direction perpendicular to the central axis of the member 10 (i.e., parallel to the arrows 14 and 16). The fibers of the material 20 of the present embodiment are all oriented in substantially the same direction as arrow 14 and the forward movement of the member 10 and opposed to the reverse movement of the member in the direction of arrow 16.

It is preferred that the fibers, as indicated above, are only substantially oriented in the direction of arrow 14. That is, they are also oriented or biased from the direction of arrow 14 toward a lateral registration edge 30 from between 0° and 15° and preferably about 8°. The fibers also extend from the material 18 at a substantial angle between approximately 20° and 60° and preferably between 45° and 30° to the horizontal plane of the material 18.

Materials of the type useful herein are well known and often are referred to as "one-way" materials. Examples of materials useful herein include "Climber P" Nylon fabric, sold as a finished fabric by Collins & Aikman Corporation Industrial Fabrics, 1,803 North Main Street, Roxboro, N.C., U.S.A., 27573, with an average pile tuft orientation angle from the horizontal or backing fabric plane of 25 to 55 degrees and a latex back coating, a trilobal filament shape, and a 37 filament count pile yarn. The fiber or pile therefore may be yarn type 6R70 of 520 Denier/37 filament Nylon supplied by Allied Fibers Inc. Suite 108 Friendship Central Park, Greensboro, N.C., U.S.A., 27409. Another material of this general type is 3M Company Brushion TM Fiber Short Trim product No. 321B (tilted fibers), or modifications thereof.

The elements of the illustrative apparatus of FIGS. 4A and 4B will now be discussed in greater detail. A sheet 39 is delivered from a sheet stacking tray 40 in which a stack of sheets 42 is disposed therein for feeding sheets individually to a sheet receiving area 43 between the fibers 20 and the platen 12 when the carriage assembly 24 has moved proximate to the limit of its travel in the direction indicated by arrow 16 (i.e., the position depicted in FIG. 4A). Sheets are fed from the tray 40 by sheet feeding means 44 which includes a retard feed roll device 46 and a sheet retard guide 48.

The member 10, as previously described, is secured for movement to the movable carriage assembly 24. The carriage assembly 24 supports the drive assembly 23, which includes a transmission 52 secured to the assembly 24 for translating imaging device means 55 perpendicular to the travel of the assembly 24, as well as translating the assembly 24. In this instance, the imaging device means 55 is depicted an ink jet printing head with a housing 58, a print nozzle 60 and an ink supply tube 62 interconnecting the nozzle with an ink supply reservoir (not shown). Thus, the nozzle 60 or a series of nozzles can scan a sheet through the action of drive assembly 23 and carriage assembly 24.

Figure 4A:
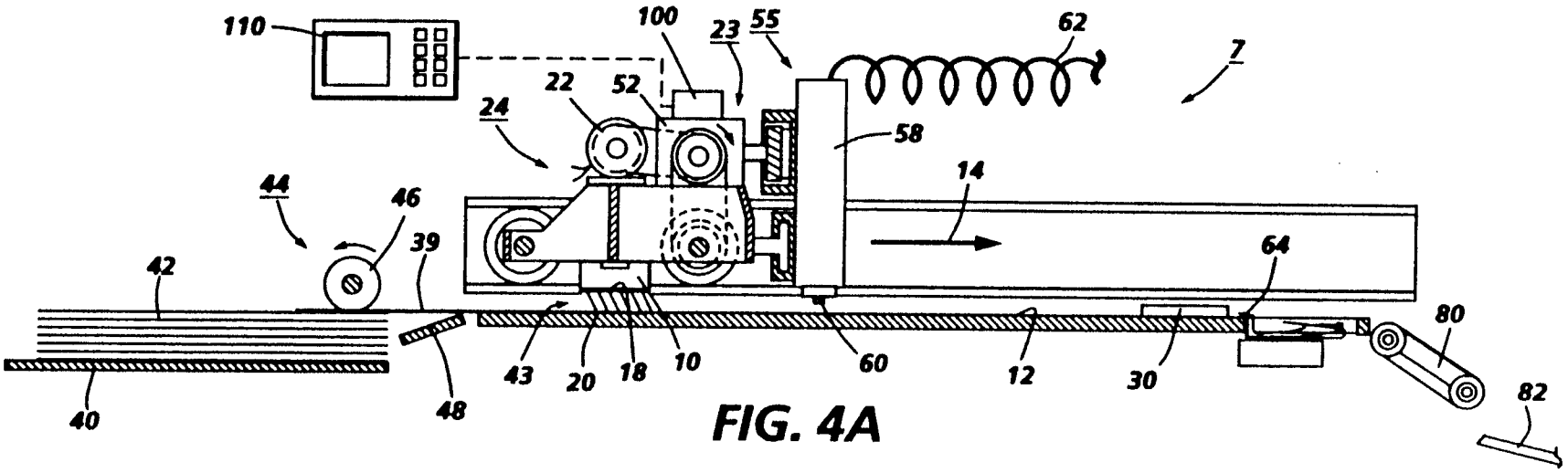
FIGS. 4A and 4B are schematic elevational views of an illustrative image processing device having a sheet handling system employing the present invention.
Figure 4B:
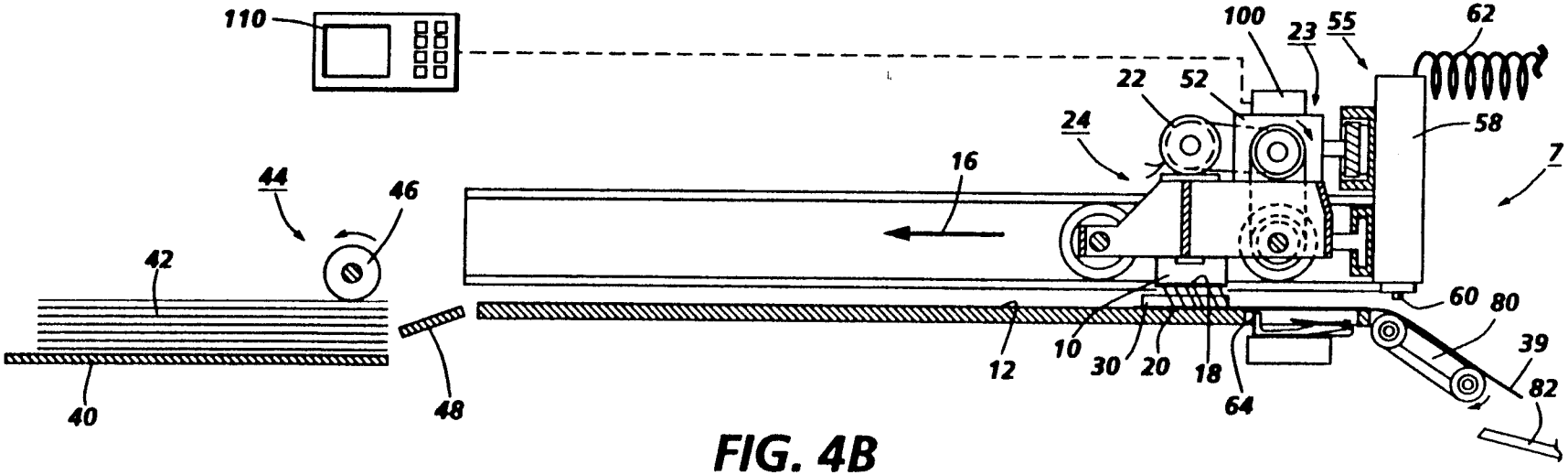

The operation of the illustrative transport means will now be more fully explained, as follows, the motor 22 drives the carriage assembly 24 from the paper receiving position, shown in FIG. 4A, to the end of the track, as depicted in FIG. 4B. A sheet of paper in the sheet receiving area 43 is translated across the platen due to the frictional engagement of the sheet with the fibers. When the leading edge of the sheet engages a front registration edge 64, the sheet 39 ceases forward translation. As previously recited, the fibers are at an angle to the direction of movement so that as the carriage assembly 24 and the fibers 20 attached to member 10 carried by the assembly 24 continue to move, the lateral forces on the sheet from the frictional engagement with the fibers are sufficient to urge the sheet in a side or lateral direction toward the lateral registration edge 30, due to the bias orientation of the fibers. Thus, the sheet 39 is translated across the platen 10 to the front registration edge 64 where it becomes registered along its leading edge, and, then laterally registered against the lateral registration edge 30.

When any portion of the leading edge of the sheet 39 engages a front registration edge 64, skewing of the sheet relative to the process direction is removed. The sheet 39 in such cases tends to rotate under the continued urging of the fibers 20 so as to register along the registration edge. It has been found that skewing of a sheet from angles ranging from about 10° to about 15° of skew from the centerline of a sheet to the process direction can be accomodated. Once the lead edge of the sheet is fully engaged along the registration edge, the sheet 39 ceases forward translation. As previously recited, the fibers 20 are at an angle to the direction of movement so that, as the carriage assembly 24 and, thus, the fibers 20 continue to move in the direction of arrow 14, the lateral forces on the sheet from the frictional engagement with the fibers are sufficient to urge the sheet in a side or lateral direction toward the lateral registration edge 30.

Transport belt 80 and sheet support 82 are also provided for sheets exiting the platen as shown in FIG. 4B. In this case, the carriage assembly 24, after returning in the direction of arrow 16 over the sheet 39, is again moved in the direction of arrow 14 to urge the sheet 39 over the front registration edge 64, which has been withdrawn from the path to an out-of-the-way position, as hereinafter described below, and to the transport belt 80.

The control signals for the image processing device 7 of FIGS. 4A and 4B are provided by the machine controller 100. The controller 100 preferably comprises a known programmable microprocessor system, as exemplified by extensive prior art. Plural but interconnecting microprocessors may be used and included at different locations of the image processing device 7 and devices associated therewith. It is contemplated that the controller 100 controls all of the machine steps and functions described herein. The controller 100 also conventionally provides for other selections by the operator through a connecting panel 1 1 0 of control switches.

Figure 5:
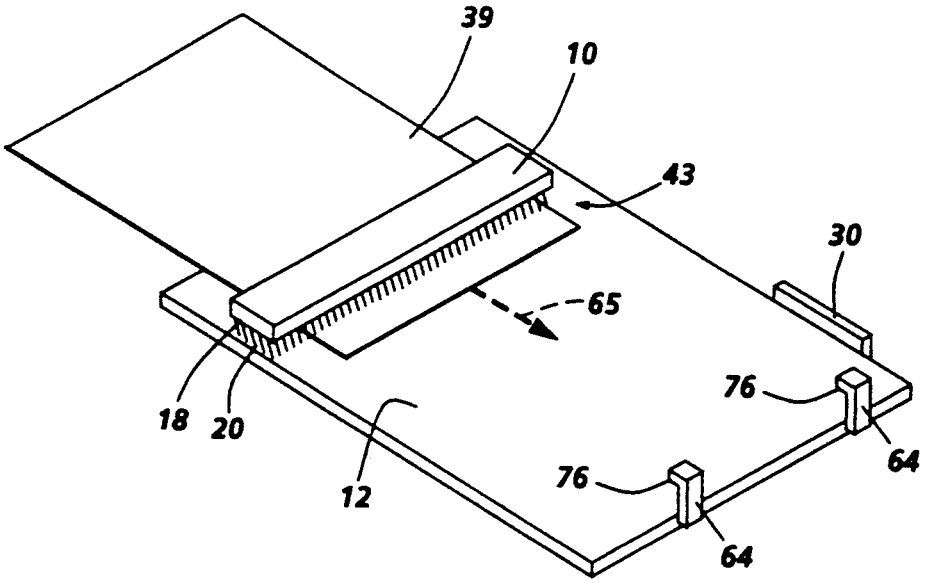
FIGS. 5, 6, 7, 8 and 9 are perspective schematic views of the sheet handling system of FIGS. 4A and 4B.
Figure 6:
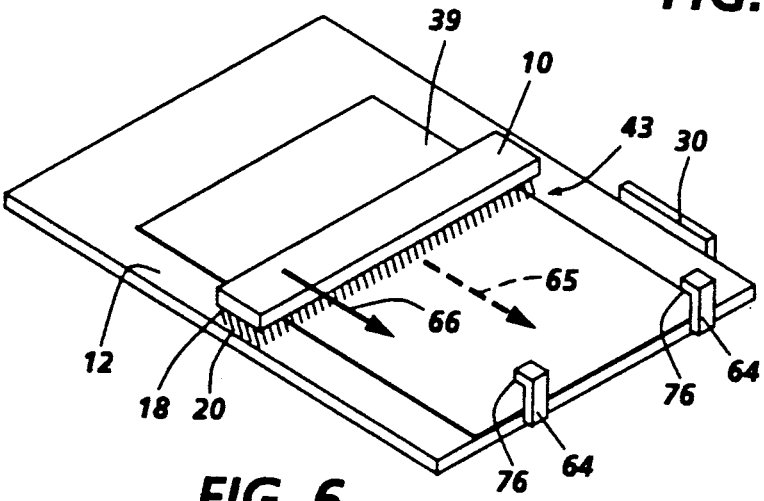

Thus, referring now to FIGS. 5, 6, 7, 8, and 9, the operation of the sheet registering and gripping apparatus of the present invention in conjunction with an illustrative transport apparatus will be now discussed in greater detail. As seen in each of the FIGS. 5, 6, 7, 8, and 9, the elongated member 10 is shown with the brush material 18 secured thereto. Further, the fibers 20 of the brush-like material 18 are shown substantially oriented in the direction of arrow 14 with the slight bias deflection toward the lateral registration edge 30. In FIG. 5, the lead edge of sheet 39, as indicated by arrow 65, has been moved through the sheet receiving nip between the platen 12 and fibers 20 at the sheet engaging position 43. Movement of the elongated member 1 0 in the direction of arrow 66 is then commenced, as shown in FIG. 6, so that the fibers 20 urge the sheet in the direction of arrow 65 toward the front registration edge 64.

Figure 7:
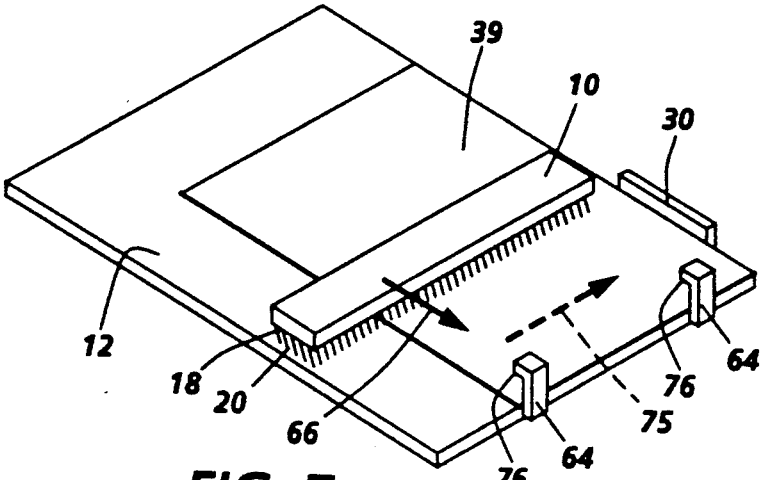
Figure 8:
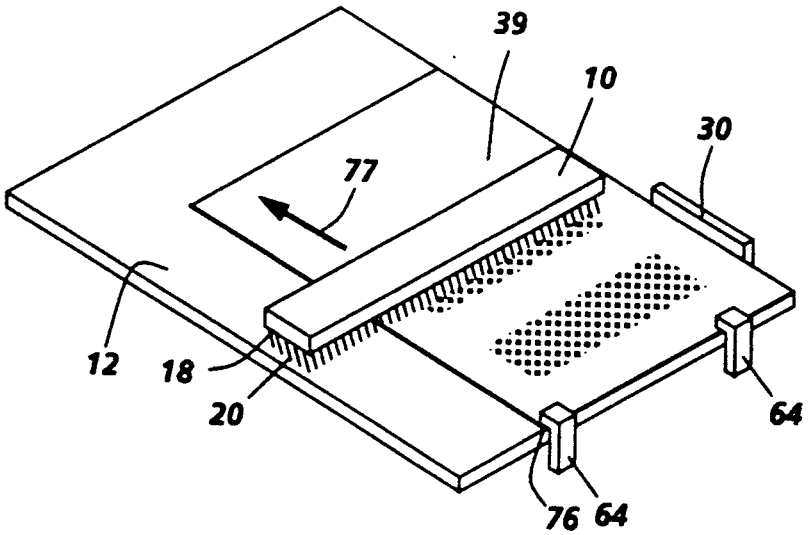
Figure 9:
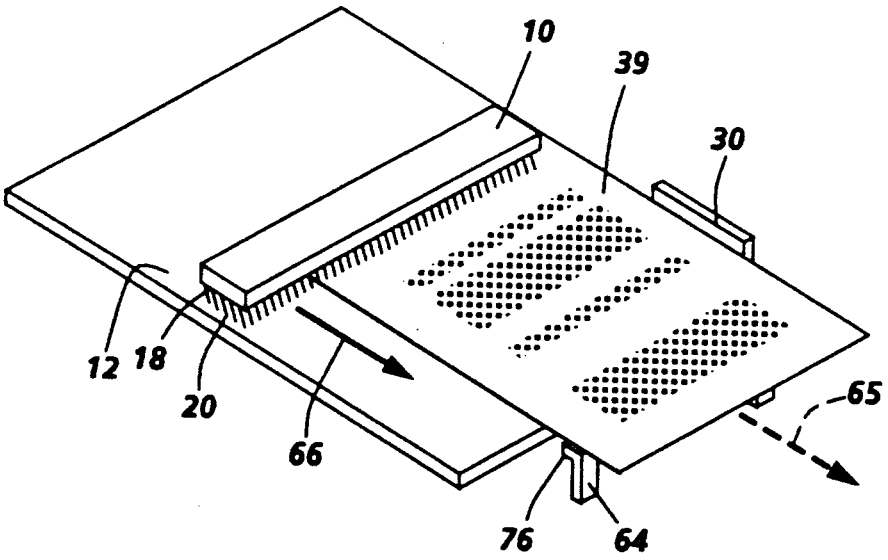

As shown in FIG. 7, the sheet 39 has reached the front registration edge 64 and has been registered thereat and the sheet 39 is now translated in the direction 75 toward the lateral registration edge 30 while the member 10 continues movement in the direction of arrow 66. In FIG. 8, the front registration edge 64 has been lowered so that the extended lip or flange 76 thereon holds the sheet 39 in position on the platen 12, and the movement of the elongated member 10 in the direction of arrow 77 and printing of the sheet 39 has commenced. Thus, as demonstrated in FIG. 8, the sheet 39 can be printed or otherwise operated on by a imaging device (not shown) carried along with the elongated member at 10. Further, as should be realized from FIGS. 8, the movement of the member 10 when a sheet is clamped under flange 76, in the direction of arrow 77 tends to smooth and flatten the sheet 39 as the fibers 20 move over the sheet 39. It will be recognized that the provision of a smooth surface improves both the imageability and/or printability of a sheet on the platen 12. Finally, in FIG. 9, the sheet 39 is shown being pushed off the surface 12 by the forward movement of the member 10 in the direction of arrow 14 after completion of the imaging of the sheet. In this instance, the front registration edge 64 has been retracted below the platen 12 so that the sheet is no longer secured to the surface by the flange 76 and the registration edge 64 does not impede the forward translation of the sheet 39 past the registration edge 64.

The operation and construction of the preferred embodiment of the present invention will now be discussed in greater detail with reference to FIGS. 1, 2, 3A, 3B and 3C, generally, and with specific reference now to FIG. 1. In FIG. 1, a front registering device 120 is shown with a front registering edge 64 and a clamping lip or flange 76, which extends substantially perpendicular from the registration edge 64. Further, the registering device 120 comprises a housing 130 which has extending portions 132 to engage and guide an actuating track 133. The actuating track 133, which is moved relative to the housing 130 by a suitably connected actuator (not shown), is shown more clearly in FIG. 2. The registering edge 64 is part of a spring 134 mounted within the housing 130. Also mounted within the housing is a bracket 135 which is secured to the spring 134 so that the bracket 135 and the registration edge 64 are biased in a downward direction relative to the housing 130. The bracket 135 has a cam follower or a downward extending portion 136 which rides in a cam track 138 formed within the actuating track 133.

The bracket 135 is pivotally and slidably mounted in apertures 142 formed in the side of the housing 130 by pins 145 which extend from the bracket 145 through the apertures. Movement of the actuating track 133 and, consequently, the cam track 138 causes the movement of the bracket 135 in both a lateral and vertical direction. Thus, movement of the track 133 relative to the housing 130 causes the translation of the registration edge 64 relative to the housing 130. In this manner, the registration edge 64 can be moved from a first active position for registering sheets to a second position for clamping sheets under the flange 76, and, finally, a third position where the registration edge and flange are positioned flush or, as depicted herein, below the top surface of the device 120 to enable transport of sheet past the registration edge 64.

Figure 3A:
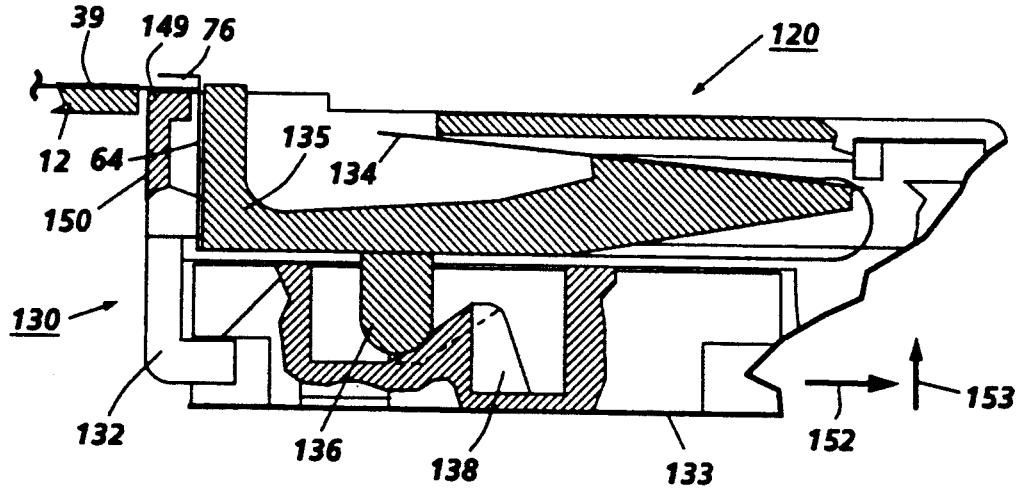
FIGS. 3A, 3B and 3C are partial sectional, elevational views taken along the lines 3A—3A, 3B—3B and 3C—3C in the direction of the arrows of FIG. 2, respectively, to illustrate the operation of the apparatus of FIG. 1.
Figure 3B:
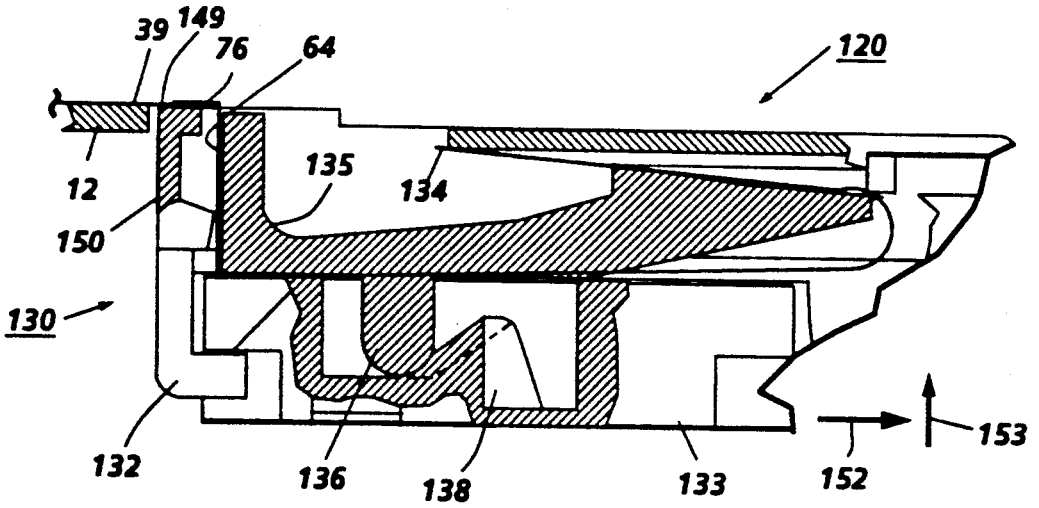
Figure 3C:
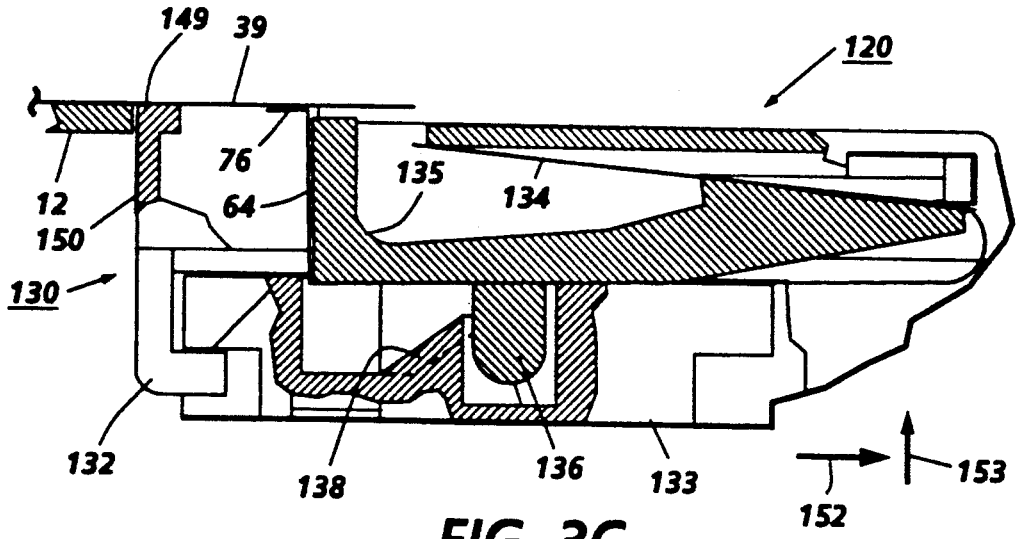

Referring now to FIGS. 3A, 3B and 3C, the housing 130 of the device 120, is depicted as mounted along a platen surface 12 with the top lip 149 of the forward portion 150 of the housing 130 flush with the platen surface 12. In FIG. 3B, the clamping flange 76 of the front registration edge 64 is shown in an operative position for clamping sheet 39 to the platen 12 at the lip 149. It will be appreciated that the lip 149 or a portion thereof may be covered by an elastomeric material to provide a deformable surface on which a sheet is gripped by the flange 76 to limit damage to a sheet gripped thereat.

Figure 2:
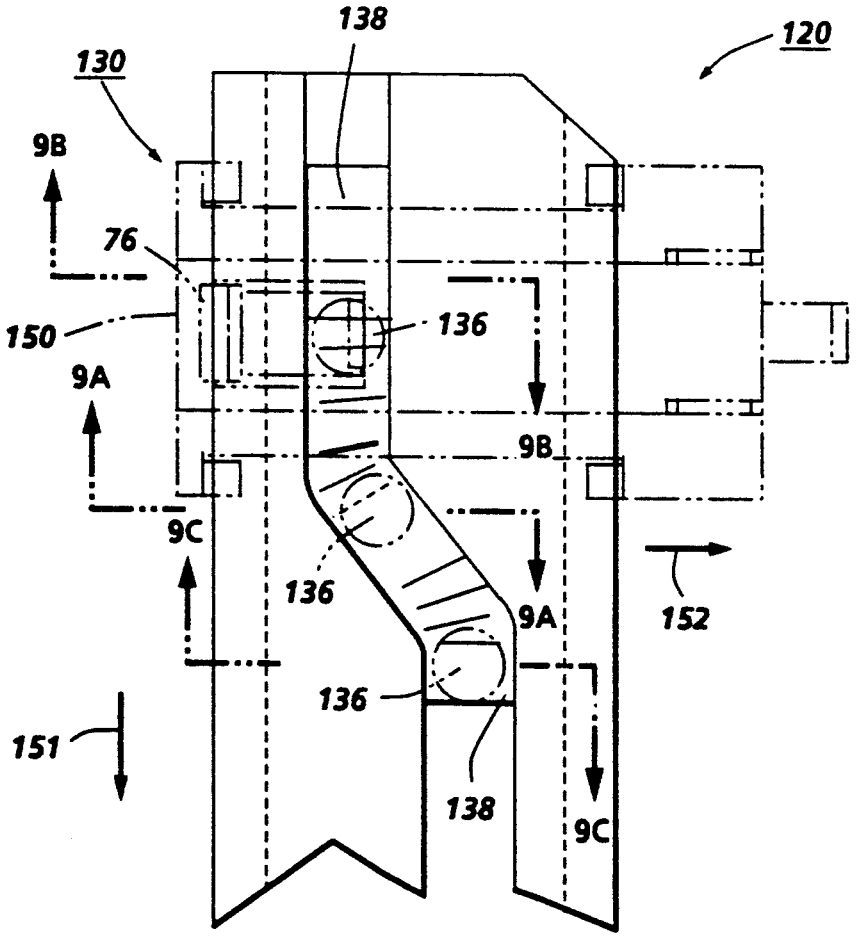
FIG. 2 is a plan view of the device of FIG. 1 with portions shown in phantom lines to illustrate an actuating track more clearly.

As the track 135 is moved in the direction indicated by arrow 151 as shown in FIG. 2, the cam track 138 causes the downwardly extending portion 136 of the bracket 134 to be displaced only a slight distance laterally in the direction of arrow 152 and vertically in the direction of arrow 153 so that the registration edge 64 assumes the position shown in FIG. 3A with extending portion 136 of the bracket 135 on a raised portion of the cam track 135. In this position the registration edge is substantially vertically aligned with the platen surface 12 to provide an edge for registering sheets.

As the actuating track 133 is continued to be moved in the direction of 151, the downwardly extending portion 136 of the bracket 138 is continued to be displaced in the direction of arrow 152 but is now lowered in a direction opposite of arrow 153 so that the registration edge 64 and clamping flange 76 are laterally displaced from the forward position of the housing and vertically displaced below the surface of the platen 12 and the lip 149, as illustrated in FIG. 3C.

Thus, in operation, as a sheet is moved toward the front registration edge 64, the front registration edge 64 is positioned, as shown in FIG. 3A, so that sheets transported across the surface 12 impact the vertical portion of the registration edge 64 and are registered thereat. After the sheet has been registered, the clamping lip 76 of the registration edge 64 is lowered to secure the sheet to the platen 12 along the top lip 149 as shown in FIG. 3B by movement of the actuation track 133 in the direction opposite of arrow 151. Thereafter, the registration edge and clamping lip 76 are moved from the position shown in FIG. 3B, through the position shown in FIG. 3A, and, finally, to the position shown in FIG. 3C by the movement of the track 133 in the direction of the arrow 151. In this manner, a sheet is released from the clamping flange 76 and the registration edge 64 is retracted below the surface of the platen 12 to enable transport of sheets past the registering and gripping device 120. Thereafter, the registration edge 64 can be returned to its sheet registering position by movement of the track 133 in the direction opposite of the arrow 151 to the position shown in FIG. 3A.

It should be recognized that several of the front edge registration and gripping devices described with respect to FIGS. 1, 2, 3A, 3B and 3C can be used in conjunction with one another to form a front registration edge rather than a unitary device (see for example FIGS. 5, 6, 7, 8, and 9). That is, for example, two devices 120, each approximately, 1 to 2 cm wide and spaced between 4 and 15 cm between centers and centered on a platen 30 cm wide, will effectively form a front registration edge for registering A-4 and 8½"×11" sheets fed long and short edge across the platen. Further, it will be appreciated that a sheet registering and gripping device in accordance with this invention can be employed with other transport applications besides the fixed platen described herein, including without limitation a moving belt on which the device for registering and gripping is secured and a moving bar on which the device for registering and gripping is secured.

In recapitulation, a sheet registering and gripping device and method for registering and gripping sheets transported along a path has been disclosed in which a sheet is transported to a registration edge positioned in a sheet registering position for registering the transported sheet thereat. The registration edge is then lowered so that an extending portion of the registration edged bears on the sheet to releasably secure the sheet. Further, the registration edge is actuable from the lower position in both a lateral direction away from the receiving area.

It is, therefore, apparent that there has been provided in accordance with the present invention, a that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A sheet registration and gripping device for sheets transported by sheet handling apparatus comprising:

a sheet registration edge including a first surface for registering the transported sheets, and a second surface substantially perpendicular to the first surface;

a gripping surface positioned proximate to said registration edge; and first means for moving said registration edge from a first position for registering sheets against said first surface to a second position for engaging sheets by said second surface and gripping sheets between said gripping surface and said second surface;

second means for moving said registration edge to a third position locating said first and said second surfaces remote from said gripping surface to enable sheets to be transported past said first surface and said second surface, said first moving means and said second moving means include means for resiliently urging said registration edge selectively to said first position, said second position, and said third position, and a camming device for moving said registration edge in a direction opposite to the direction of movement urged by said resilient means, said camming device is a cam which defines a track having said registration edge disposed therein.

2. The device of claim 1, wherein said cam includes raised portions in the track for actuating said first and said second surfaces between the first and second positions.

3. The device of claim 2, wherein said resilient means urges the registration edge downwardly from said first to said second position as said registration edge moves from a raised portion to a lower portion of said track.

4. The device of claim 1, wherein said cam includes laterally displaced portions in the track so as to move the registration edge laterally responsive to movement of the cam from a position having the track adjacent the gripping surface to a position having the track remote from the gripping surface to enable the sheet to be transported past said gripping surface and said registration edge without engagement thereof.

5. The device of claim 1, including a platen with a sheet supporting surface, and at least two closely adjacent sheet registration fingers, wherein said first surface comprises at least two sheet stopping surfaces on said registration fingers which are closely adjacent to one edge of said platen; and wherein said gripping surface comprises tab portions of said registration fingers extending over said one edge of said platen sheet supporting surface in said first position for griping a sheet against said platen sheet supporting surface, and wherein said camming device moves said registration fingers relative to said platen sheet supporting surface in said second position to a position which allows unobstructed ejection of a sheet from said platen sheet supporting surface.

* * * * *